US006782818B2

(12) United States Patent
Glöckner et al.

(10) Patent No.: US 6,782,818 B2
(45) Date of Patent: Aug. 31, 2004

(54) METHOD FOR ADJUSTMENT OF A BELT TENSION IN A ROTARY PRESS MACHINE

(75) Inventors: Erhard Herbert Glöckner, Eibelstadt (DE); Dieter Koch, Oberrohrdorf (CH)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/181,945

(22) PCT Filed: Jan. 5, 2001

(86) PCT No.: PCT/DE01/00012

§ 371 (c)(1),
(2), (4) Date: Aug. 1, 2002

(87) PCT Pub. No.: WO01/56792

PCT Pub. Date: Aug. 9, 2001

(65) Prior Publication Data

US 2003/0015109 A1 Jan. 23, 2003

(30) Foreign Application Priority Data

Feb. 4, 2000 (DE) ..... 100 04 933
Jun. 2, 2000 (DE) ..... 100 27 471

(51) Int. Cl.[7] ..... B41L 5/06

(52) U.S. Cl. ..... 101/228; 101/231; 101/484; 101/DIG. 42; 226/24; 226/29

(58) Field of Search ..... 101/228, 231, 101/DIG. 42, 220, 221, 225, 227, 232, 248, 484, 485, 486; 226/2, 24, 29, 32, 57, 62, 631, 75, 115

(56) References Cited

U.S. PATENT DOCUMENTS

| | | | | | |
|---|---|---|---|---|---|
| 3,025,791 | A | | 3/1962 | Auerbacher | |
| 3,561,654 | A | * | 2/1971 | Greiner | 226/25 |
| 3,707,658 | A | * | 12/1972 | Hilsenbeck | 318/7 |
| 4,214,524 | A | * | 7/1980 | Corse | 101/181 |
| 4,435,883 | A | * | 3/1984 | Muszynski | 26/71 |
| 5,709,331 | A | | 1/1998 | Lam et al. | |
| 5,904,093 | A | * | 5/1999 | Pollock | 101/177 |
| 5,937,756 | A | | 8/1999 | Kishine et al. | |
| 6,499,397 | B2 | * | 12/2002 | Stern | 101/248 |
| 6,546,871 | B1 | * | 4/2003 | Glockner | 101/484 |
| 2003/0188661 | A1 | * | 10/2003 | Fischer | 101/485 |

FOREIGN PATENT DOCUMENTS

| | | |
|---|---|---|
| DE | 36 39 992 C1 | 5/1988 |
| DE | 29 51 246 C2 | 1/1992 |
| DE | 198 34 725 A1 | 2/2000 |
| EP | 0 737 638 A1 | 10/1996 |
| EP | 0 914 944 A2 | 5/1999 |
| EP | 0 951 993 A1 | 10/1999 |

* cited by examiner

*Primary Examiner*—Andrew H. Hirshfield
*Assistant Examiner*—Kevin D. Williams
(74) *Attorney, Agent, or Firm*—Jones, Tullar & Cooper PC

(57) ABSTRACT

The tension of a web in a rotary printing machine is monitored and adjusted. The web runs through at least one printing group in the rotary printing machine. Any change in the stretch of the web during the production run is determined by noting any difference between first and second speeds of the web. The change in stretch is compensated for by a change in the tension of the web before the first printing group.

17 Claims, 1 Drawing Sheet

METHOD FOR ADJUSTMENT OF A BELT TENSION IN A ROTARY PRESS MACHINE

FIELD OF THE INVENTION

The present invention is directed to a method for controlling a web tension in a rotary printing press. The web passes through at least one printing unit and the web's tension is adjusted before that at least one printing unit.

BACKGROUND OF THE INVENTION

EP 09 51 993 A1 discloses a register-preserving actuation for a rotary printing press, in which a longitudinal stretch of the printing web is ascertained from web tension values and operational data of the drive units and is compensated for by adjusting the circumferential register on the cylinders or the register rolls. A change in the lateral stretch, which is ascertained by a sensor for detecting web width, is restored to its original value by changing the reference value of the draw roller, which is adjusted to a constant web tension.

U.S. Pat. No. 3,025,791 A discloses a method for controlling the drive units of a printing press with the aim of achieving a constant web stretch. The measurement of the web stretch in this instance takes place in close proximity to the first printing unit, through comparison of the angular position of the printing unit and then the position of a mark on the print stock. A change in the relative position between the angular position of the printing unit and the position of the mark results in a tension change for the print stock web in the infeed unit.

DE 198 34 725 A1 discloses a number of methods for controlling web tension. The web tension is measured, and with this measurement the tension is restored to a reference value or a reference range for the tension or is restored to a mathematically calculated speed for a lagging or retarding or an advancing of one drive unit in relation to a second drive unit. The web tension in this instance is kept constant by use of a simple web tension control, a web tension control that has been expanded to include a presettable reference value for the speed, or a lag control—with or without DROOP behavior.

DE 29 51 246 C2 discloses a device used in a printing press, which makes it possible to adjust the speeds of a paper web at different points in relation to one another, in an example, the drive unit of the printing unit on the one hand and that of the draw roller on the other. In this case, by use of motor shaft encoders, impulses that correspond to the speed of the web can be detected and are supplied to a motor control circuit

SUMMARY OF THE INVENTION

The object of the present invention is to provide a method for controlling a web tension in a rotary printing press.

The object is attained according to the invention by the measurements of web speed at first and second locations along the path of web travel. A change in the difference in these speeds is the result of a change in web tension. This change in web tension can then be controlled. The change in web tension can be made before the web enters a first printing unit in the rotary printing press.

The advantages that can be achieved with the present invention are comprised particularly in the fact that by measuring and comparing the circumferential speeds of the last printing unit and of the subsequent draw roller, a number of objects can be inexpensively fulfilled, without incurring substantial additional expenses related to measurement techniques. The stretch or tension of the web is kept constant despite fluctuating web properties and operating parameters.

In particular, when starting up a printing unit, a printing tower, or an entire multi-web rotary printing press, there is often a printing startup without the use of water and/or ink, i.e. with a dry web. Before a printing startup of the cylinders occurs, a largely uniform web tension prevails before and after the printing units since the web is not placed under tension by the printing units. For the web travel, though, it is advantageous if after printing startup, but during the operation of the press without water and/or ink, the web tension is also approximately the same before the first printing unit and after the last printing unit. This is the case if the circumference speeds of the last printing unit and the subsequent draw roller are approximately the same, which can be advantageously assured by the present invention.

When the water and ink are switched on, the tension or stretch behavior of the web changes as it passes through the printing zones. This results in a tension reduction after the last printing unit since the subsequent draw roller is, for the time being, still traveling with the same circumferential speed as the last printing unit. So that a trouble-free entry of the webs into the hopper of the web former and folder is assured in multi-web operation, in order to achieve the necessary graduation in the web tension, after the water and/or ink are switched on, but before the print run speed has been reached, the appropriate web tension level of the webs are matched to each other, if possible only by adjustments to the infeed unit.

The paper web stretches under the influence of the wetting agent and/or the ink in both the longitudinal and lateral directions of the web with respect to the web transport direction. Particularly in multicolor printing, where there are free path lengths between adjacent printing zones, this paper web stretching is reflected in a fan-out effect or a spreading of the print image or of several adjacent print images as they continue on their way through the printing zones. Provided that this so-called fan-out effect remains virtually constant over time in each printing zone, the effect can be at least partially compensated or counteracted by, for example, printing formes which are disposed so that they diverge in a corresponding manner. The stretch behavior of the paper web, however, is subject to numerous influences, such as the tension or stretch characteristics of the respective paper and consequently the prevailing tension, the current moisture, the moisture sensitivity, the penetration behavior, and even the position of the roll as it is produced in the reel, which is reflected, for example, in a variable winding hardness.

The stretch, both the longitudinal and lateral stretch of the paper web, is therefore not steady or constant due to inconstant paper properties of the unrolling paper web itself and due to changing and partially fluctuating operating parameters in the printing press. For example, the paper web on the roll may have been subjected to an uneven winding in its manufacture, may exhibit a location-dependent fluctuation in its modulus of elasticity, or other irregularities. As a rule, these properties vary greatly from paper type to paper type. Even with the same paper type, the properties can vary considerably from roll to roll. On the other hand, a fluctuating web tension, changing printing speeds, fluctuations in the wetting of the web, or a roll change influence the stretch of the paper web so that the longitudinal stretch and the lateral stretch of the web in relation to the transport direction are not steady or constant over time.

When there are fluctuations in the properties of the web and also changing operating parameters, for example in the wetting of the web, the mathematical correlation of a tension or a stretch characteristic curve is abandoned and that curve changes to a temporarily unknown characteristic curve. Furthermore, if only a constant tension is set, this results in a deviation in the stretch and in the effective unwinding length of the print image on the web B, which results in errors in the image length on the web B and also in the circumference and/or side register. The method for controlling web tension in accordance with the present invention eliminates this disadvantage. The web stretch is kept constant even with the above-mentioned inconstant web properties and/or operating conditions.

The method in accordance with the present invention advantageously assures a more reliable starting procedure, establishes a normal setting, and compensates for additional fluctuations in the stretch in the longitudinal and/or lateral directions of the web.

In a preferred embodiment, during the starting phase, which typically occurs without ink and water, the draw roller disposed after the last printing unit is driven in a speed-controlled fashion in relation to a printing unit. During print running, this draw roller is torque-controlled in respect to a presettable reference value. The speeds of the draw roller and of the printing unit, that continue to be measured during a print run, are used to control the infeed unit. After print run speed has been reached, the difference between the circumference speed of the draw roller, which as a rule increases during print running, and the circumference speed of the printing unit constitutes a reference value. A change in this difference or in this reference value indicates a change in the web tension or stretch, not only in a longitudinal stretch but also in a lateral stretch of the print stock web, and consequently a change in the image length on the web B and/or in the lateral and longitudinal register. The torque control produces a temporary speed change of the drive unit of the draw roller. The relative speed change in turn then controls the infeed unit, which finally permits the torque-controlled draw roller to return to its "normal operation". A change in the stretch or in the tension of the paper web is measured after the last printing unit. However, a controlling action is executed at the infeed unit, which action defines the overall tension level of the paper web. Advantageously, there is no direct feedback to the draw roller situated after the printing unit. Instead, there is a change in the overall tension level at the infeed unit. A particularly advantageous feature of the present invention is the fact that the web tension after the draw roller is kept largely constant, which can be achieved through combination of the torque-controlled draw roller with the control of the infeed unit as to the difference between the circumference speeds, without additional expenses related to measurement and control techniques.

It is advantageous if the tension or the stretch change in the web is ascertained at the end of the printing tower or after the last printing unit. This offers a good insight for the additional processing steps as to the overall change and makes it possible to execute a countermeasure to achieve a constant tension of the web for the subsequent paths of the web. In this sense, it is also advantageous that the control of the web tension does not take place in the vicinity of the measurement zone, but at the beginning of the web. This establishes a base level for the course of the tension, without causing significant changes in the web tension in the superstructure, in particular before the hopper infeed roller of the web former and folder.

A virtually constant portion in the longitudinal stretch, for example for the purpose of preadjusting the printing press for the expected or measured operating conditions and paper conditions, can be compensated, for example by register adjustment in the cylinders, by the use of register rolls, or by other devices.

It is also advantageous that both the first requirement discussed previously for a speed-controlled startup, and, after the switching on of the water and ink, the second requirement for a control of changes in the fan-out effect or the lateral register and in the image length when the web tension after the draw roller is kept largely constant, are fulfilled without requiring, for example, additional systems for image detection or the like in order to preserve the lateral register.

BRIEF DESCRIPTION OF THE DRAWINGS

A preferred embodiment of the present invention is shown in the drawings and will be explained in detail below.

DESCRIPTION OF THE PREFERRED EMBODIMENT

Figure 1:
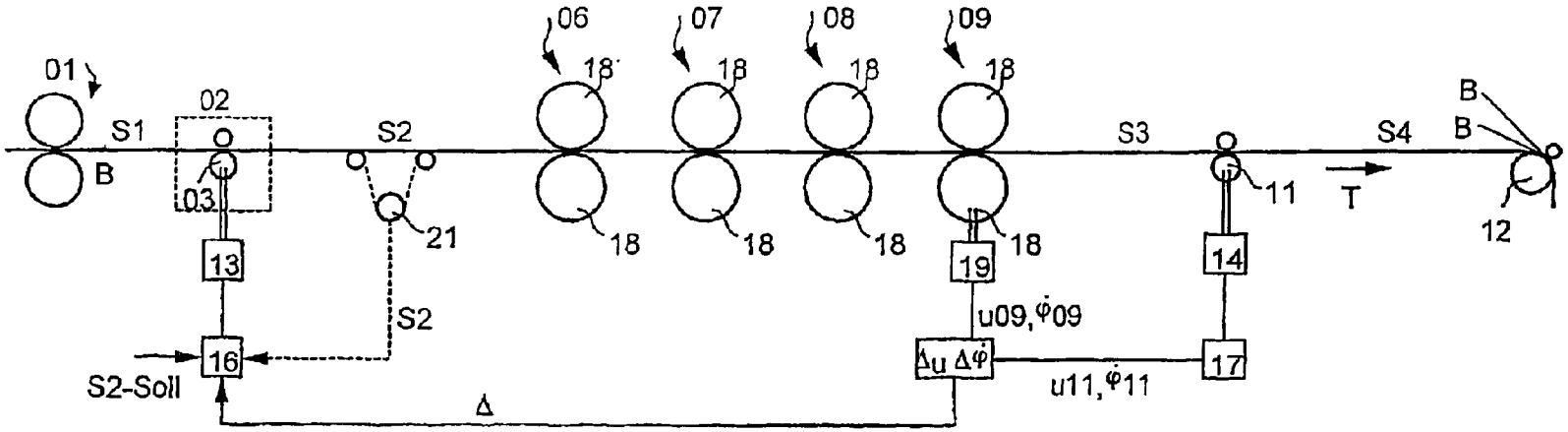
FIG. 1 is a schematic depiction of an arrangement for the guidance of a web from an infeed unit, via four printing units, and a second draw roller, to a hopper infeed roller for use in practicing the method for controlling web tension in a rotary printing press in accordance with the present invention.

Referring initially to FIG. 1, there is schematically depicted the passage of a web B, for example a print stock web B or a paper web B, on its path through a printing press, in particular a rotary printing press. The web B travels in the transport direction T from a roll changer 01, through an infeed unit 02 with a first or infeed draw roller 03, through four printing units 06 to 09, and to a second draw roller 11. The second draw roller 11 is followed, for example, by turning bars, cutting blades, additional draw rollers or guide rollers, none of which are specifically depicted in FIG. 1, and finally a hopper infeed roller 12, which is typically part of a longitudinal former and folder. The essential draw rollers 03 and 11 are each equipped with their own drive units 13 and 14 and each drive unit has a drive control unit 16 or 17, respectively. In a preferred embodiment, tensions S1; S2; S3; and S4 of the web B are measured before the infeed unit 02, between the infeed unit 02 and the first printing unit 06, between the last printing unit 09 and the second draw roller 11, and on the free path between the second draw roller 11 and the hopper infeed roller 12. This can be accomplished, for example, by the utilization of measuring rollers or by measurement of the power consumption of the drive motors of the traction units; i.e. by drive units 13 and 14, for example.

The starting point for the adjustment of web tensions, particularly when, in multi-web operation, a number of webs B are combined at the hopper entry to form a multi-ply composite web B on the hopper infeed roller 12, is the absolute and relative tensions S4 of the individual webs B in relation to one another on the hopper infeed roller 12, with several webs B being indicated in FIG. 1. The adjustment of the tensions in the webs B takes place based on the desired tension level in the hopper infeed roller 12. Preferably, the web tension level is established by adjusting the infeed unit 02. A change in the web tension also preferably takes place by a change in the tension S2 at the infeed unit 02. In order to place the web B under tension, the first or infeed draw roller 03 is operated so that its speed lags behind or is less than the machine speed. During print running, i.e. at production speed and with the addition of water and ink, the second draw roller 11 is, as a rule, driven so that its speed advances ahead of or exceeds the machine speed. The machine speed is measured, for example, at a cylinder 18, for example a transfer cylinder 18 of the last printing unit 09. The circumference speed u09 of this last printing unit transfer cylinder 18 can be ascertained, for example, by measurement of the rotation angle position or the phase position ϕ09 or by the change over time in the rotation angle position or phase position ϕ'09 or by the position of a drive unit 19 or by use of a mark and a detector on the transfer cylinder 18 or another cylinder such as the forme cylinder or counter-pressure cylinder.

The first or infeed draw roller 03 and the hopper infeed roller 12 and if need be, drive units disposed between the second draw roller 11 and the hopper infeed roller 12 can be controlled in terms of their speed and/or rotation position for operation at production speed. In particular, the draw roller 03 can be regulated in such a way that the tension S2 between the infeed unit 02 and the first printing unit 06 is continuously restored to or maintained at a reference value.

At printing startup, the second draw roller 11 is operated without water and/or ink, i.e. with a dry web B, in a controlled manner that uses its circumference speed u11 as a control variable and during print running, is operated with water and ink in a torque-controlled manner.

In terms of the travel of a dry web B, it is advantageous if the same web tensions S2 and S3 prevail before the first printing unit 06 and after the last printing unit 09. Since, in the dry state, the web B is not exposed to any significant stretch due to moisture influences, in this phase, the circumference speeds u09 of the last printing unit 09 and the circumference speeds u11 of the second draw roller 11 should consequently be approximately the same. An increase in the speed of the draw roller 11 would lead to unnecessarily high tensions S3 of the web B or possibly even to web breakage. The drive unit 14 of the second draw roller 11 is correspondingly actuated by the drive control unit 17, in that the two circumference speeds u09 of the printing unit 09 and u11 of the draw roller 11 are compared and a possibly occurring difference Δu is corrected to the circumference speed u09 predetermined by the machine speed. This is achieved, for example, by increasing or decreasing the circumference speeds u11 of the second draw roller 11 so that Δu is approximately equal to 0 or so that Δu lies within presettable tolerance limits.

When the water and ink are switched on, the tension and stretch behavior of the web B changes as it passes through the individual printing zones of the printing units 06 to 09. This results in a decrease in the tension S3 after the last printing unit 09, since, for the time being, the second draw roller 11 is still traveling with the same circumference speed u11 as the last printing unit 09. After this, and during print running, the draw roller 11 is then operated in a torque-controlled manner. So that a trouble-free entry of the webs B into the hopper of the longitudinal former and folder, of which the hopper infeed roller 12 is a part, is assured in multi-web operation, preferably, in order to achieve the necessary, known graduation in the web tensions S4 of several webs B in relation to one another, after the water and/or ink are switched on, but before the print run speed has been reached, the appropriate web tension level of the web B is matched, if possible only by adjustments to the infeed unit 02. This can take place, for example, by use of the first or infeed draw roller 03 or by use of a dancing roller, not specifically shown, which is disposed in the infeed unit 02.

Figure 2:
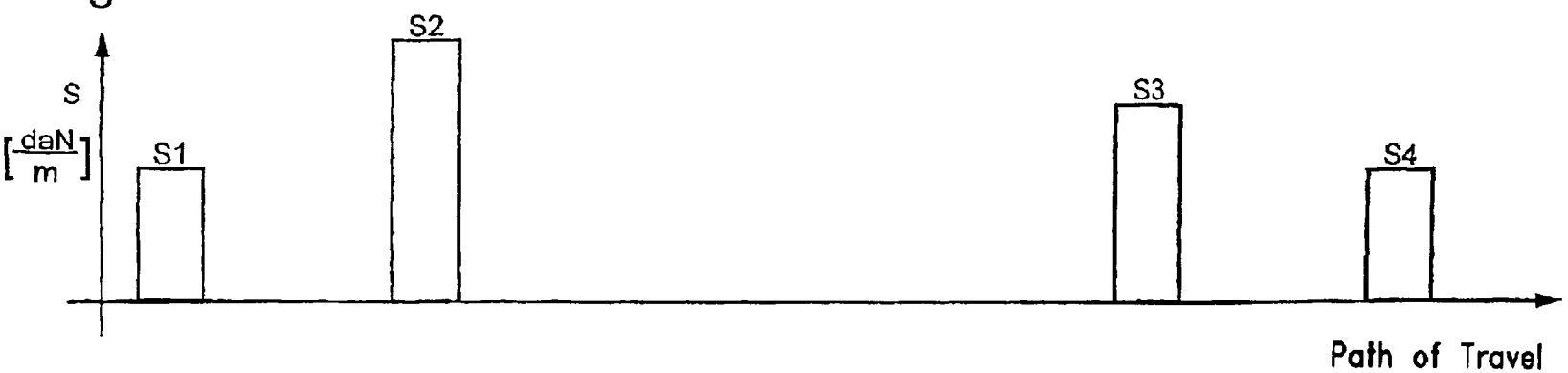
FIG. 2 schematically depicts the web tension level during a print run.

A normal setting of the web tensions S1; S2; S3; S4 during print running, as schematically depicted in FIG. 2, is produced, for example, by operation of the web tension-controlled, speed-controlled, or position-controlled first or infeed draw roller 03, which results in a control of the hopper infeed roller 12 and/or of additional dancing rollers, not specifically shown. This tension-controlled state of the web B, by use of a lagging or a retardation of the speed of the draw roller 03, and an advancing or increase of the speed of the draw roller 11 in relation to the machine speed, takes into account a constant portion, expected or measured of a longitudinal change in the web B, which takes place after and during the passage of the web or webs B through the printing units 06 to 09 due to moisture influences. Even symmetrical and constant fan-out effects in the lateral register of the web or webs B can already be taken into account here.

In order then during print running to be able to counteract changes or fluctuations in the lateral register or in the image length, of the kind that can occur, for example, during roll changing, during adjustments to the fountain solution, during speed changes, etc., the circumference speed u09 of the last transfer cylinder 18 and the circumferential speed u11 of the second draw roller 11 are again compared and an existing difference Δu is stored as a reference value Δu-ref in the storage unit. This should subsequently be equivalent to the ascertainment of the phase position ϕ09 or of the change, over time, in the phase position ϕ'09 and of a rotation angle position or phase position ϕ11 or of the change, over time, in the phase position ϕ'11, where a change is measured as a difference Δϕ' and is recorded as Δϕ'-ref in the storage unit. Then during print running in continuous production, if a deviation in the difference Δu (Δϕ') from the reference value Δu-ref (Δu' ref) occurs due to one of the above-mentioned reasons, then this is an indicator of and quantification of changes in the paper properties and/or in the stretch ϵ in the paper and consequently also for relative changes in the circumference ink register in the lateral register, and/or in the image length. A greater stretch, for example, permits the torque in the second draw roller 11 to fall temporarily, whereupon this roller, since it is operated in a torque-controlled fashion, reacts by increasing the circumference speed u11. The actual value of the difference Δu then deviates from the previously stored reference value Δu-ref. This deviation, and therefore also the deviation in the lateral register, the circumference register, and/or the image length is then compensated for by the infeed unit 02 preceding the first printing unit 06 until the torque-controlled second draw roller 11 once more reaches the circumference speed u11 required for the reference value Δu-ref. The circumference speeds u09 of the printing unit 09 and u11 of the second draw roller 11 can be ascertained directly in one of the cylinders associated with the printing unit 09, for example directly in the transfer cylinder 18 or directly in the second draw roller 11, or can be ascertained by use of an encoder disposed in a drive unit 14 or 19 or by means of a rotation sensor. The second circumference speed u11 or phase position ϕ11 (ϕ'11) can also be ascertained for another roller or another cylinder in the transport direction T after the last printing unit 09, for example by the provision of a rotation sensor in an additional measuring roller.

The deviation from the reference value Δu-ref (Δϕ'ref) can be superimposed on a reference value generator of the drive control unit 16, for example in the form of an interference variable Δ. The drive control unit 16 of the first or infeed draw roller 03 can, for example, be torque-controlled, which produces a restoring of the tension S2. A path of the web B over a corresponding measuring roller 21 for the measurement of the tension S2 of the web B is shown with dashed lines in FIG. 1. The reference value generator of the drive control unit 16 is superimposed by the interference variable Δ that corresponds to the deviation from the reference value Δu-ref, for example in the form of a correction variable ΔS2. A correction variable ΔS2 of this kind can, for example, be taken from a stored curve or can also be generated iteratively by increasing or decreasing the tension S2 until the difference Δu of the circumference speeds u09 and u11 once again corresponds to the reference value Δu-ref.

The circumference speeds u09 and u11 should be set equal to the speed u09; u11 of the web B (with curvature of the web B on the contact side) when the slippage is negligible. Consequently, in another embodiment of the invention, the speeds u09; u11 of the web B or their difference Δu can also be used as the interference variable Δ for controlling the tension S2 if they are derived in another way. It is essential, however, that the speed u09 is the machine speed or the speed u09 of the web B in the vicinity of the printing units 06; 07; 08; 09 and that the speed u11 is the speed u11 of the web B after the last printing unit 09. Here, too, it is advantageous to embody the second draw roller 11 so that it is torque-controlled during print running.

If abrupt changes in the influence of force on the web B are to be avoided, a drive control unit with DROOP behavior can also be used for the first or infeed draw roller 03. DROOP behavior is a term used for a load-dependent change of the reference value of a circumference speed or rotation speed, which takes into account both a change in the tension of the web B, e.g. S4, and a change in the circumference speed, e.g. u11. In this case as well, the reference value S2-ref for the web tension S2 is superimposed by a correction variable ΔS2 as an offset, which, together with the actual value of the tension S2, in conjunction with the DROOP function, produces an appropriate lag or speed reduction of the first draw roller 03.

Whatever the method used for controlling the first draw roller 03 or the infeed unit 02, it is essential that the reference value for the drive control unit 16 be superimposed by an interference variable Δ ascertained from the difference Δu, for example as a correction variable ΔS2 of the desired tension S2. As needed, or under certain conditions, instead of being ascertained based on the last printing unit 09 in the transport direction T, which has the circumference speed u09, the machine speed can also be ascertained based on another printing unit 06 to 08. The difference Δu and the reference value Δu-ref must then be ascertained, for example, from u11 and u08, etc. and processed as interference variables Δ.

It is also essential that a change in this difference Δu permits the inference of a change dϵ in the stretch ϵ, the longitudinal stretch and/or lateral stretch ϵ of the web B after the last printing unit 09, and consequently a change in the lateral register and/or the image length of the web B, and that this results in a temporary speed change in the drive unit 14 of the second draw roller 11. The relative speed change or deviation in the difference Δu from the reference value Δu-ref then, in turn, leads to the control of the infeed unit 02, which finally permits the torque-controlled draw roller 11 to return to its "normal operation". A change in the stretch or in the tension of the web or webs B is measured after the last printing unit 09, but a control is executed at the infeed unit 02, which defines the overall tension level of the paper web B. Advantageously, there is no direct feedback to the second draw roller 11 situated after the last printing unit 09; instead, a change in the overall tension level of the web or webs B takes place at the infeed unit 02.

In lieu of the circumference speeds u09 and u11, as discussed above, the angular positions of one of the printing units 06 to 09 and of the draw roller 11 can be used. When there is a change dϵ in the stretch ϵ, then there is consequently a deviation in the relative angular position. This difference value can then be used, in the form of an absolute value or as an absolute value with a sign, as an interference variable Δ for the control of the drive unit 13.

The method for controlling a web tension in a rotary printing press, in accordance with the present invention, is suitable for printing presses with stacked printing units or for printing units which are disposed next to one another, which are combined to form bridge units or H-units, for rubber-against-rubber or rubber-against-steel printing units and other combinations.

While a preferred method for controlling a web tension in a rotary printing press in accordance with the present invention has been set forth fully and completely hereinabove, it will be apparent to one of skill in the art that changes in, for example the specific type of rotary printing press used, the overall size of the press, and the like could be made without departing from the true spirit and scope of the present invention which is to be limiting only by the following claims.

What is claimed is:

1. A method for controlling a web tension in a rotary printing press including:

providing at least one printing unit in the rotary printing press;

passing a web to be printed through said at least one printing unit;

measuring first and second speeds of web travel at two different locations in the rotary printing press;

determining a speed difference between said first and second speeds;

providing a reference value for said speed difference between said first and second speeds;

comparing said determined speed difference with said reference value for said speed difference;

sensing an amount of a change in said determined speed difference between said first and second speeds;

using said amount of said change in said determined speed difference between said first and second speeds for ascertaining an amount of a change in longitudinal stretch in said web after said at least one printing unit;

changing a tension in said web before said at least one printing unit in response to said amount of said change in longitudinal stretch in said web after said at least one printing unit; and using said change in tension in said web before said at least one printing unit for controlling said longitudinal stretch in said web after said at least one printing unit.

2. The method of claim 1 further including:

measuring said first speed as a circumferential speed in said at least one printing unit;

providing a web draw roller after, in a web transport direction, said at least one printing unit;

measuring said second speed at a circumferential speed in said web draw roller;

recording said speed difference between said first and second speeds as said reference value;

determining said determined speed difference between said first and second speeds during print operations of the rotary printing press;

providing a web infeed unit for controlling a tension in said web before said at least one printing unit;

comparing said determined speed difference with said reference value and determining a deviation;

forming an interference variable using said deviation; and using said interference variable for controlling said infeed unit.

3. The method of claim 2 further including controlling said draw roller as a function of a presettable torque.

4. The method of claim 1 further including providing a measuring roller after said at least one printing unit and using said measuring roller for measuring said second speed.

5. The method of claim 2 further including providing an encoder in said draw roller and using said encoder for measuring said second speed.

6. The method of claim 1 further including providing a plurality of printing units and measuring said first speed in a last one of said plurality of printing units in a transport direction of the web.

7. The method of claim 2 further including providing a web infeed draw roller having a drive control unit before, in said direction of web travel, said at least one printing unit, measuring a web tension between said web infeed draw roller and said at least one printing unit, and providing said interference variable to said drive control unit as a correction variable to said drive control unit.

8. The method of claim 1 wherein said first and second speeds are ascertained based on rotation angle positions.

9. The method of claim 2 further including controlling said draw roller during a starting phase of the rotary printing unit as a function of a speed.

10. A method for controlling a web tension in a rotary printing press comprising:

providing at least one printing unit in the rotary printing press;

passing a web to be printed through said at least one printing unit;

measuring a first speed of web travel as a circumferential speed in said at least one printing unit;

providing a web draw roller after, in a web transport direction, said at least one printing unit;

measuring a second speed of web travel as a circumferential speed in said web draw roller;

determining a speed difference between said first and second speeds;

recording said speed difference between said first and second speeds as a reference value;

using said speed difference between said first and second speeds for ascertaining a change in a longitudinal stretch in said web after said at least one printing unit;

determining an actual speed difference between said first and second speeds of web travel during operation of the rotary printing press;

providing a web infeed unit;

comparing said actual speed difference with said reference value and determining a deviation;

forming an interference variable using said deviation in said actual value. from said reference value;

using said interference variable for controlling said infeed unit; and using said infeed unit for tensioning said web before said at least one printing unit in response to said change in said speed difference until said reference value for said speed difference is reached.

11. The method of claim 10 further including controlling said draw roller as a function of a presettable torque.

12. The method of claim 10 further including providing a measuring roller after said at least one printing unit and using said measuring roller for measuring said second speed.

13. The method of claim 10 further including providing an encoder in said draw roller and using said encoder for measuring said second speed.

14. The method of claim 10 further including providing a plurality of printing units and measuring said first speed in a last one of said plurality of printing units in a transport direction of the web.

15. The method of claim 10 further including providing a web infeed draw roller having a drive control unit before, in said direction of web travel, said at least one printing unit, measuring a web tension between said web infeed draw roller and said at least one printing unit, and providing said interference variable to said drive control unit as a correction variable to said drive control unit.

16. The method of claim 10 wherein said first and second speeds are ascertained based on rotation angle positions.

17. The method of claim 10 further including controlling said draw roller during a starting phase of the rotary printing unit as a function of a speed.

* * * * *